United States Patent [19]

Rieger

[11] 3,963,253

[45] June 15, 1976

[54] SAFETY SKI BINDING

[75] Inventor: Hermann Rieger, Immenstaad, Germany

[73] Assignee: Vereinigte Baubeschlagfabriken Gretsch and Co. GmbH, Germany

[22] Filed: May 13, 1974

[21] Appl. No.: 469,674

[30] Foreign Application Priority Data

May 12, 1973 Germany ..... 2324078
Jan. 15, 1974 Germany ..... 2401729

[52] U.S. Cl. ..... 280/616; 280/607; 280/617

[51] Int. Cl.[2] ..... A63C 9/085

[58] Field of Search ..... 280/11.35 D, 11.35 C, 280/11.35 K, 11.35 R, 11.35 Y, 11.35 M, 11.35 T, 11.13 W

[56] References Cited

UNITED STATES PATENTS

| | | | |
|---|---|---|---|
| 3,232,631 | 1/1966 | Witschard | 280/11.35 T |
| 3,271,040 | 9/1966 | Spademan | 280/11.35 T |
| 3,731,943 | 5/1973 | Wilkes | 280/11.35 D |
| 3,797,844 | 3/1974 | Smolka et al. | 280/11.35 C |
| 3,817,543 | 6/1974 | Haff | 280/11.13 W |
| 3,825,273 | 7/1974 | Greene | 280/11.35 K |
| 3,852,896 | 12/1974 | Pyzel | 280/11.35 R |

*Primary Examiner*—M. H. Wood, Jr.
*Assistant Examiner*—David M. Mitchell
*Attorney, Agent, or Firm*—Craig & Antonelli

[57] ABSTRACT

Safety ski binding apparatus including a ski plate fixedly securable to a ski, a boot plate detachably securable to a ski boot by way of securing means, resilient connecting means connecting the ski and boot plates to one another while permitting relative movement of said plates about a plurality of mutually perpendicular axes, and signal means interposed for producing a single signal representative of relative movement of the plates, which signal effects release of the ski boot from the boot plate in response to a critical predetermined movement of said plates relative to one another.

49 Claims, 18 Drawing Figures

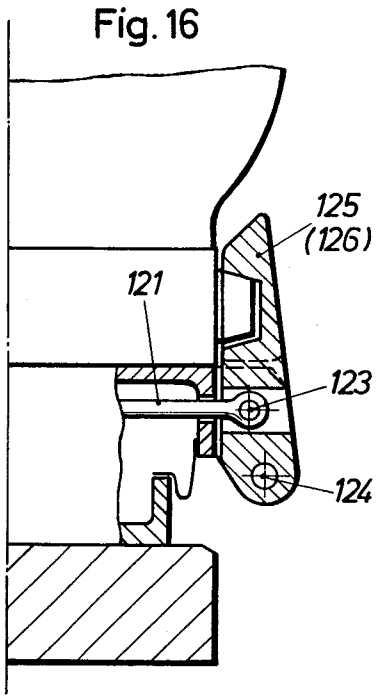
Fig. 16
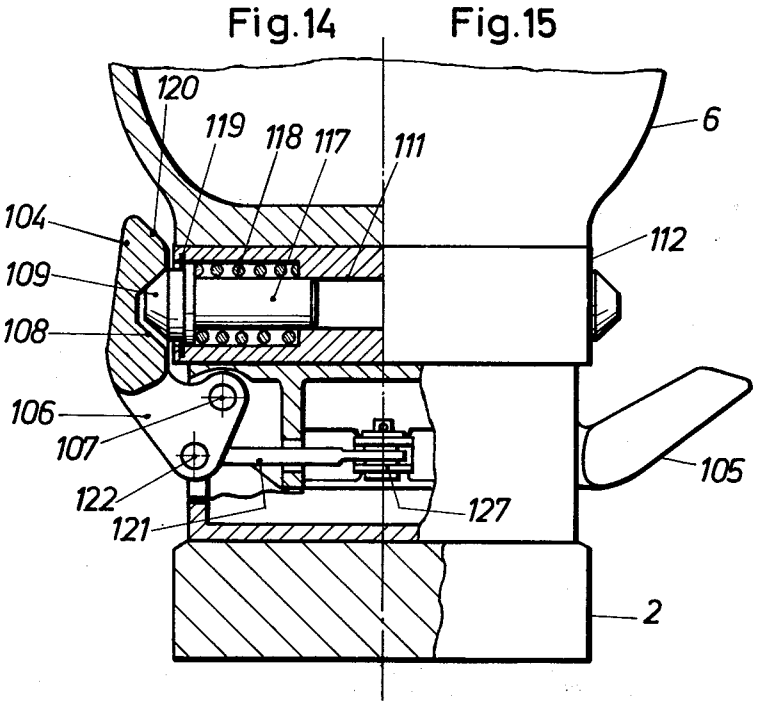
Fig. 15
Fig. 14

SAFETY SKI BINDING

The invention relates to a safety ski binding as a device for clamping the ski boot to the ski having an overload safety device whose release system is separate from the boot securing system.

Most known constructions of safety ski bindings have a toe jaw and a heel jaw which are fixed directly to the ski and are clamped between the sole of the boot.

These bindings all open on reaching a particular force which is applied directly above the boot on the particular jaw and which counteracts or removes the jaw locking force.

An important disadvantage of such bindings is that the release largely depends on the frictional conditions and contact pressures between boot and ski/binding. This means that the release is influenced by the stance of the skier (greater stressing of the ball or heel of the foot), the correct mounting of the separate jaws relative to one another, snow and ice left between the binding portions, the state of deformation of the skis (jamming between the jaws) and the condition, material and surface characteristics of the boot.

In other known bindings a metal plate is used which is fixed to the boot and on releasing the safety mechanism is separated from the ski together with the boot. However, this construction can only prevent the influencing of the release values by the latter factor (boot). This also applies in the case of other known constructions of plate bindings wherein the toe and heel jaws are replaced by coupling members underneath the plate and which correspond to the function of the jaws. In every case the plate is separated from the ski together with the boot as a result of direct action on the securing system. This also applies to another variant where after separation there is still a hinged connection between boot and ski on all sides, but this merely replaces the retaining strap.

Another group of bindings is known whose securing and release mechanism is incorporated directly in the boot, whereby the sole of the boot is sub-divided into two halves which on releasing the securing mechanism are separated from one another. However, this type is disadvantageous in that the skier must use a particular boot.

The final group of bindings comprise systems which are released by an electrical signal. In one version this signal is produced by an accelerometer with which however it is not possible to obtain an unequivocal coordination with the stresses of the leg, and which furthermore does not function if a person falls when stationary. In another construction the release mechanism is operated by a switch which acts when particular forces occur on the toe of the boot. In these constructions it is disadvantageous that an electrical energy source (battery) is necessary, whereby it is difficult to check whether it is operative and in addition electrical systems are very prone to faults and are sensitive to temperature.

With one exception all the described constructions have one feature in common:

The securing mechanism release takes place separately with lengthwise falls (forwards or backwards in the longitudinal direction of the ski) and twisting falls and independently, or at least indeterminately in the case of diagonal falls. The disadvantages of this and the increased risk of injury are described for the first time in DOS German Offenlegungsschrift No. 1,920,484. The binding described therein superimposes the bending and twisting stresses of the leg in the toe jaw, thereby bringing about a considerable reduction to the risk of injury in the case of diagonal falls. However, it is disadvantageous that the superimposition only takes place linearly according to a mathematical law which certainly does not correspond to the breaking hypothesis of bones. In addition this binding has the disadvantages mentioned hereinbefore.

The problem of the invention is to provide a safety binding which does not have the above-indicated disadvantages. In particular the release must take place independently of frictional forces, contact pressures of the boot, twisting movements, incorrect mounting, snow and ice residue, the type and characteristics of the ski boot and deformations of the ski when loaded. The release system must operate on loading resulting from falls in the forwards, backwards and sideways directions. The superimposition of the bending and twisting moment portions about the different leg axes is thereby realized. The shape change-energy hypothesis of isotropic materials is used as the basis for the superimposition law or this can be realized if in future special hypotheses for bones exist. No matter what type of fall is involved, the complete securing system must completely open and no parts thereof, e.g. the plate, must be detached with the boot. Release must also be ensured in the case of falling in the stationary position and must not be dependent on the point at which the force is applied to the ski. There must be a certain degree of impact energy absorption. In addition the release mechanism must be protected against external influences such as snow, water, salt, dust.

The problem is solved by a functional separation of the release system from the boot securing system in that according to the invention two resilient interconnected plates are used which, however, do not separate in the case of an overload, whereof one is mounted on the ski or is integrated therewith, and the other contains the securing system for the ski boot. The relative movements performed by the boot plate relative to the ski plate in the case of loading in any direction are superimposed in a particular manner and produce a signal which on reaching the critical value causes the securing system to suddenly and completely open, whereby the boot which was securely clamped until then is released. An important difference compared with known bindings having plates to be fixed to the boot is that on release the plate remains connected with the remainder of the binding and therefore with the ski.

Independently of the friction and clamping conditions between boot and ski or binding, the release mechanism produces a load-related signal which on reaching a critical value (critical stressing of the leg) gives the order for a sudden and complete opening of the clamping device, so that the boot is released. Two resilient movable and interconnected plates whose load-dependent relative movements are determined are used for producing the release signal. Release takes place with any type of fall (forwards, backwards, sideways or in combined directions) and therefore with all possible combined boundary stresses of the leg, whereby the different stress components (e.g. twisting, bending) are coupled according to a specific mathematical law.

An important advantage of the described solution is that the release signal is produced in an almost force-free and therefore friction-free manner, and the separate securing system opens reliably independent of the type and characteristics of the boot. The deformation of the ski when loaded (when skiing or stationary) are also unimportant because the ski plate is made correspondingly rigid or is fixed to the ski in such a way that the plate cannot become deformed.

A preferred embodiment of the boot securing system provides a completely novel clamping of the boot. Unlike in the known bindings the boot is not fastened at the toe and heel but is instead secured laterally to the left and right on the sole of the boot.

This has the decisive advantage that the binding or securing system does not have to be adjusted to the boot size which eliminates some of the sources of error during the fitting and adjustment of the binding. It is also possible to standardize the dimensions of the central portion of the sole to which the attachment is made and to make it identical for all boot sizes. The remaining portion of the boot can then be constructed in random manner and does not impair the function of the binding. The central portion of the sole is, according to the invention, constructed in a rigid manner, e.g. as a metal member, which can be embedded during the production of the outer surface or is subsequently attached as a fitting. This sole portion has to the left and right projections, e.g. having the shape of a frustum or sphere, and can be pressed inwardly under spring tension. This is necessary so as to permit stepping in with the jaws closed and to give a certain elasticity, e.g. due to any snow residue. To ensure that the shin bone axis always passes through the rotation axis of the binding, the central portion of the sole with its projections is appropriately mounted or incorporated in a position which is clearly defined for each boot size and is therefore no longer adjustable.

The locking or unlocking of the jaws takes place via a per se known toggle lever system which can be constructed as a single or double toggle lever. The double toggle lever has the advantage that the reaction of external forces on the pin is reduced and the precision is greater. To obtain a positive guidance between the left-hand and right-hand jaws and a definite closed position, a synchronization lever is incorporated. It connects the two jaws with the toggle lever system which functions in the horizontal plane. A toggle lever has a roller in its toggle joint which rolls on a circular surface of a control lever which is connected by its other lever arm to the displacement transducer (e.g. pin) of the release system. The width of the control lever is defined in such a way that after reaching the critical path the toggle bearing is released and therefore the securing system unlocked. The jaws now open under the action of the external forces or by means of the incorporated spring. An important feature of this construction is that all conceivable external forces and moments always exert an opening force on the jaw system.

The binding is closed manually in simple manner by springing the jaws back into the initial position. Only a limited force has to be exerted to overcome the force of the opening spring. According to the invention the system requires no tension springs in the conventional sense. When the jaws are back in the closed position the skier steps into the binding by placing the boot with the projections onto the jaws provided with an inclined plane and presses downwards, so that the movable projections temporarily slide into the sole and the boot can engage between the jaws.

The manual opening of the binding takes place by pressing in or displacing the displacement transducer (pin) so that the toggle lever system is unlocked.

Other and further objects of the present invention will be apparent from the following description and claims and are illustrated in the accompanying drawings which by way of illustration show preferred embodiments of the present invention and the principles thereof, and what are now considered to be the best modes contemplated for applying these principles. Other embodiments of the invention embodying the same or equivalent principles may be used and structural changes may be made as desired by those skilled in the art without departing from the present invention and the scope of the appended claims.

FIG. 14 is a half section through the clamping jaws according to the line XIV—XIV of FIG. 12;

FIG. 15 shows the clamping jaws of FIG. 14 in the open condition;

FIG. 16 shows a further embodiment of the clamping jaws in half-section along the line XIV—XIV of FIG. 12;

Figure 1:
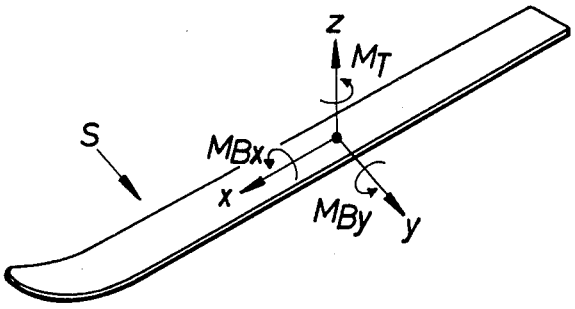
FIG. 1 is a schematic representation of the ski designating the axes, moments and forces.
Figure 2:
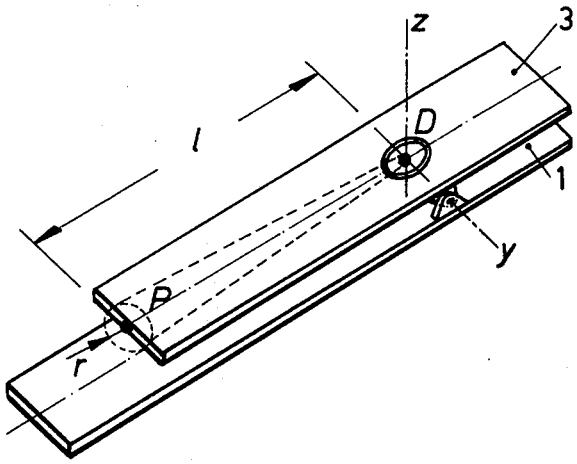
FIG. 2 is a schematic representation of the most important parts of the ski binding according to the invention.

FIG. 2 shows schematically two plates 1,3 whereof the lower plate 1 is fixed to the ski and the upper plate 3 is detachably fixed to the ski boot. To effect load-dependent displacements of the two plates 1,3 which according to FIG. 2 are parallel to one another, the said plates can be interconnected by resilient members which permit all levels of rotational and translational freedom and which are dimensioned appropriately for the forces occurring with different types of falls. According to a preferred embodiment the mobility according to FIG. 1 is limited to the most important degrees of freedom, namely rotation about the vertical axis ($z$)(torsion) as well as rotation about the horizontal transverse axis ($y$) and longitudinal axis ($x$)(bending). All three rotation axes must intersect at one fulcrum point whereby the vertical axis $z$ passes through the shin bone axis which is effected by a combined bearing, e.g. ball-bearing, between the two plates 1,3. Therefore the moments about the fulcrum point always correspond to the bending or twisting moments introduced into the leg quite independent of the point on the ski on which the disturbing force S acts.

The following comments refer, relative to FIG. 2, to a still further simplified embodiment which has only the most important practical degrees of freedom, namely rotation about the vertical axis $z$ and about the horizontal transverse axis $y$. Between plates 1,3 in addition to pivot bearing D a further connection is incorporated in the form of two not shown spiral springs or torsion rods running in the longitudinal direction of the ski which provide such a resistance to the torques about the $y,z$ axes that the relative movement between the plates 1,3 remains small, being just sufficient to derive a control signal for opening the toe and/or heel jaws (not shown) arranged on plate 1. The use of two springs with a specific spacing in the $y$ direction makes it also for example possible to produce a rotation resistance about the horizontal longitudinal axis $x$ which is not considered further here. The rigidity ($c$) of the torsion rods in the horizontal transverse direction ($y$) and in the vertical direction ($z$) is such that they correspond to the ratio of permitted twisting moment $M_{Tmax.}$ to permitted bending moment $M_{By\ max.}$ of the leg.

If in FIG. 2 a point p on upper plate 3 having the spacing 1 from fulcrum point D is considered then this point is displaced in the $y$ or $z$ direction on applying twisting or bending moments. If it is therefore desired that the binding is released with all displacements of point p after reaching the circle:

$$y^2+z^2=r^2 \qquad 1.$$

whereby radius $r$ is considered to be constant, then a vectorial superimposition of the moments (in both rotation directions) is obtained in accordance with the law:

$$\left[\frac{M_T}{M_{Tmax.}}\right]^2 + \left[\frac{M_B}{M_{Bmax.}}\right]^2 = 1 \qquad (2)$$

Figure 3:
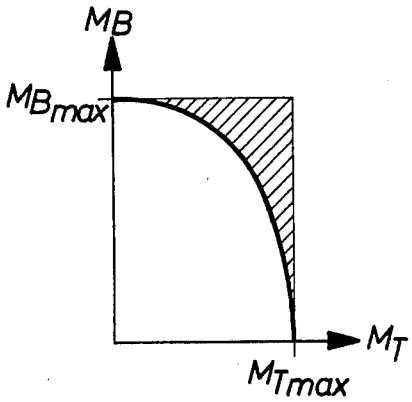
FIG. 3 is a graph of the release curve.

This relationship is shown graphically in FIG. 3 and corresponds to the inventors selected desired strength hypothesis.

By suitably modifying the release circle into another curve (function) random hypotheses which may in future be determined for bones can be taken into consideration.

Figure 4:
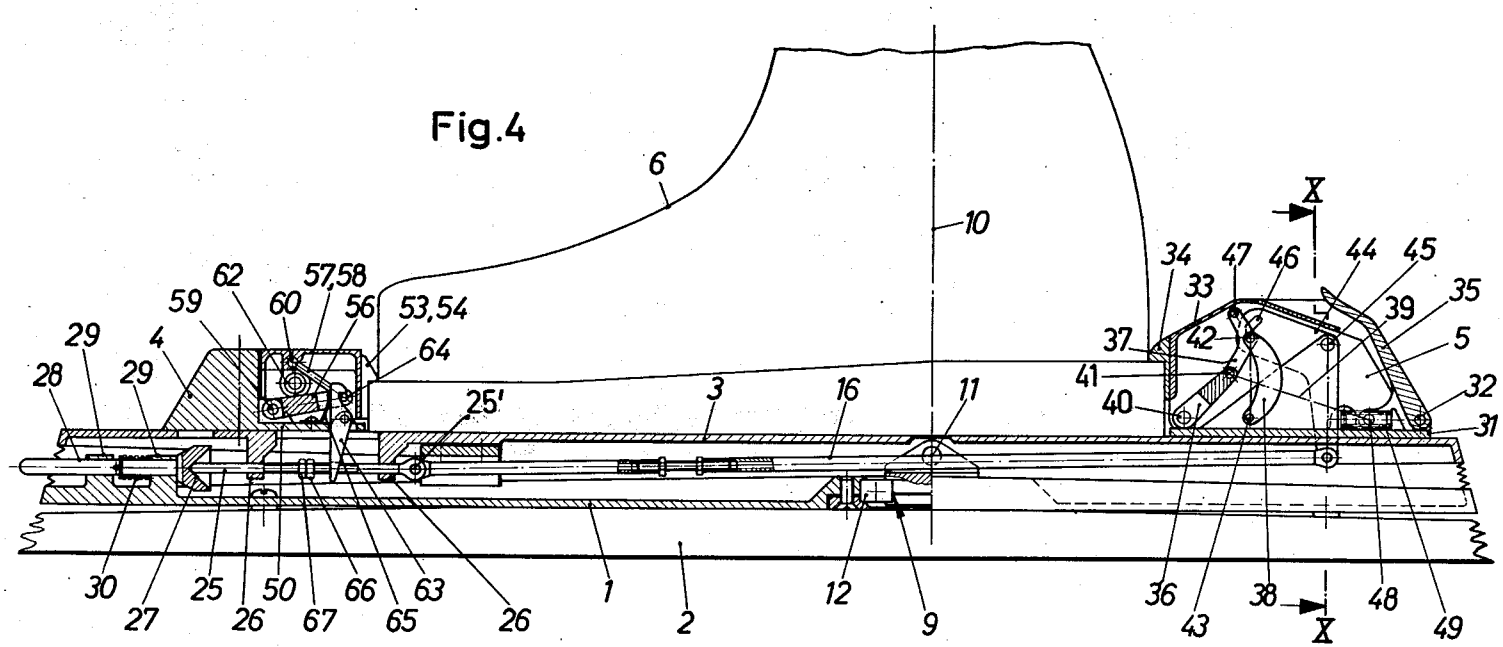
FIG. 4 is the safety binding according to the invention in central longitudinal section along the line IV—IV of FIG. 5.
Figure 5:
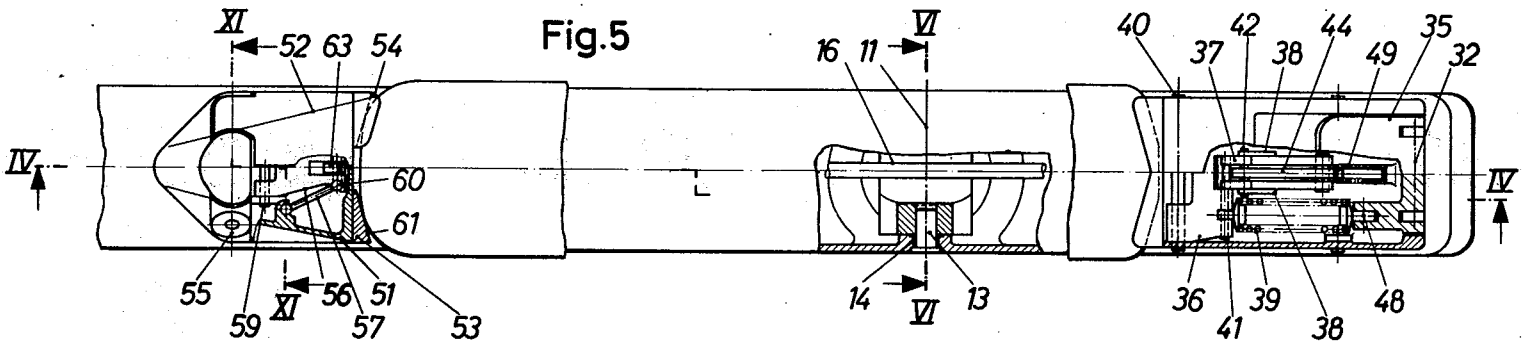
FIG. 5 is a plan view partly in section of the binding without the ski.
Figure 6:
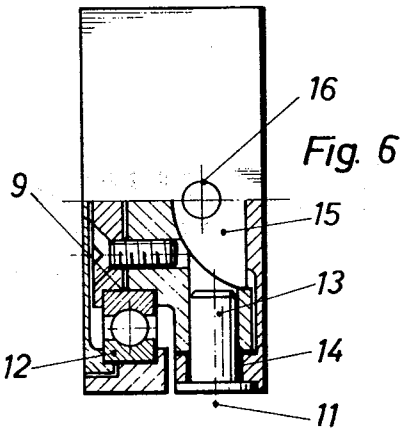
FIG. 6 is a section along the line VI—VI of FIG. 5.
Figure 9:
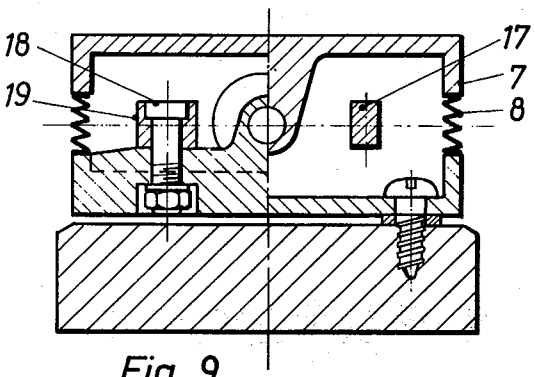
FIG. 9 is a section along the line IX—IX of FIG. 7.
Figures 12, 13:
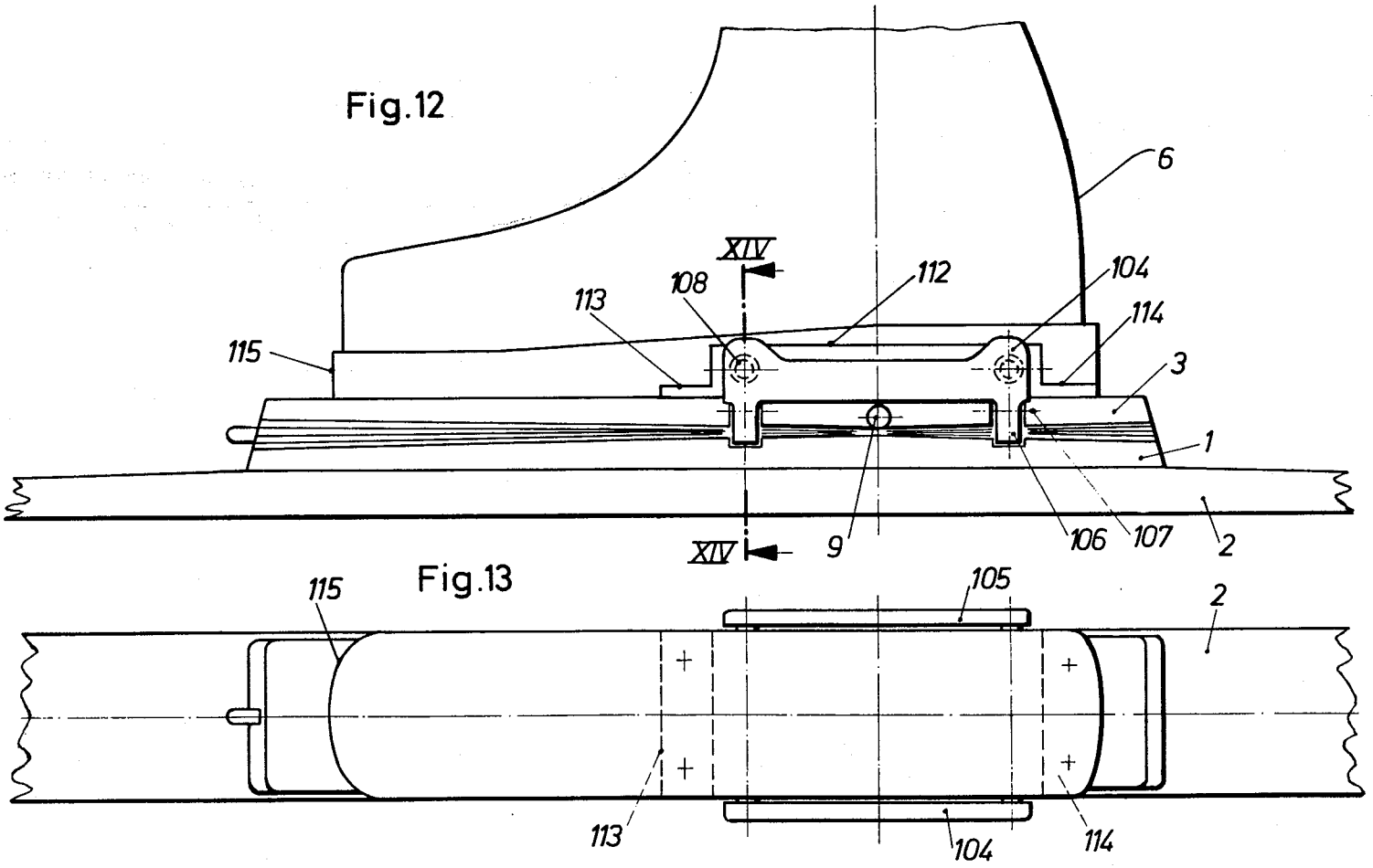
FIG. 12 is a side view of the securing system with a safety ski binding according to the previous figures.
FIG. 13 is a plan view of the securing system of FIG. 12.

According to FIGS. 4 and 5 the represented safety binding comprises the plate 1 fixed to ski 2 and the boot plate 3, to which are attached a toe jaw 4 and a heel jaw 5 between which is clamped the boot 6. According to FIG. 9 the two plates are provided with ribs 7 for reinforcement purposes. The space between the plates is protected against environmental influences by an expandable sealing member 8. The plates are interconnected by a bearing 9 having a vertical rotation axis 10 (FIG. 4) passing through the shin bone axis, and a horizontal rotation axis 11 in the same plane as the vertical axis 10 and being at right angles to the longitudinal direction of the ski. To reduce friction the pivot bearing about the vertical axis 10 is in the form of a ball bearing 12, whilst the pivot bearing about the horizontal transverse axis 11 is in the form of anti-friction bearings comprising bolts 13 and Teflon bushes 14. A space 15 for the passage of a rod 16 is recessed out of the centre of bearing 9 (FIG. 6).

Two torsion rods 17 (FIGS. 7, 8, 9) form a further connection between plates 1 and 3, whereby the thickened front ends 19 of the said springs are fixed by means of screws 18 to plate 1. The other end of the torsion rod spring 17 is connected to plate 3 by means of a clamping device comprising screws 20, a block 21 and shaped members 22. As a result a rotation-elastic bearing is provided about the axes 10 and 11 which is effective in both rotation directions. This means that the upper plate 3 can rotate upwards, downwards and to both sides under the action of moments. The length of the torsion rods and their cross section are matched in such a way that on reaching the permitted twisting moment in the shin bone a predetermined deflection of the springs takes place in the horizontal direction and on reaching the permitted bending moment the same deflection occurs in the vertical direction. When both moments occur simultaneously there is a diagonal deflection of predetermined size.

In order to be able to set the permitted moments, i.e. the release moments of the binding in the case of a predetermined maximum deflection the effective position of the spiral spring 17 can be changed. For this purpose a slide 23 is used, by means of which shaped members 22 can be slid over tongues 24 after detaching screws 20. A scale 24*a* indicates the release hardness and the manufacturer can precisely calibrate this to the moments so that an adjustment of the measuring devices is unnecessary on sale.

Figure 7:
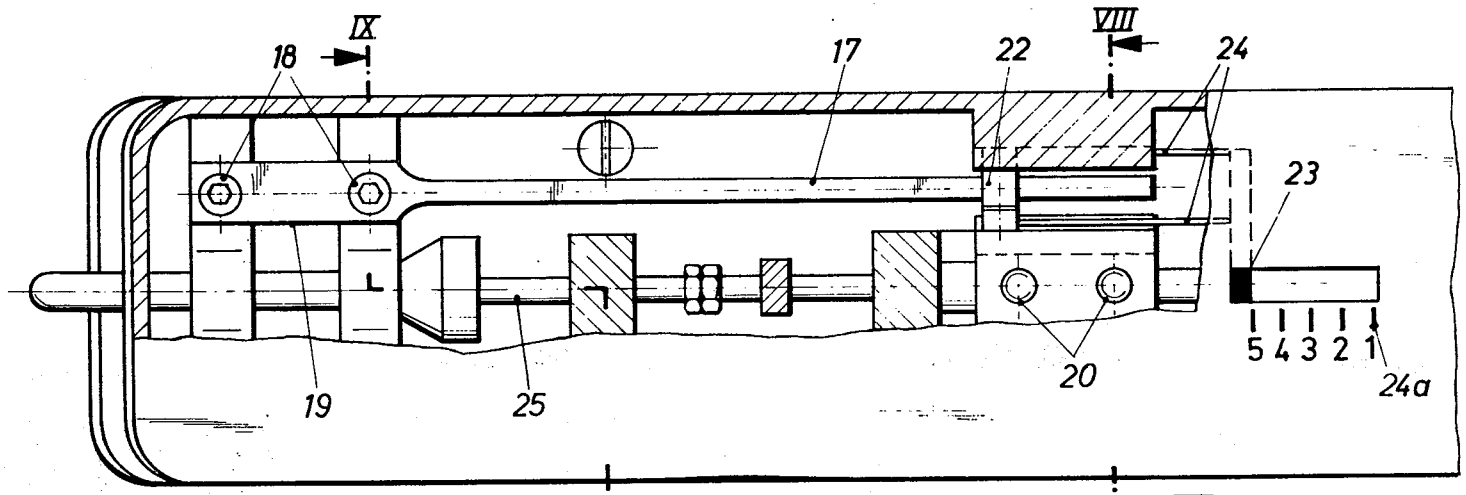
FIG. 7 is a horizontal section through the toe portion of the binding along the line VII—VII of FIG. 8.
Figure 8:
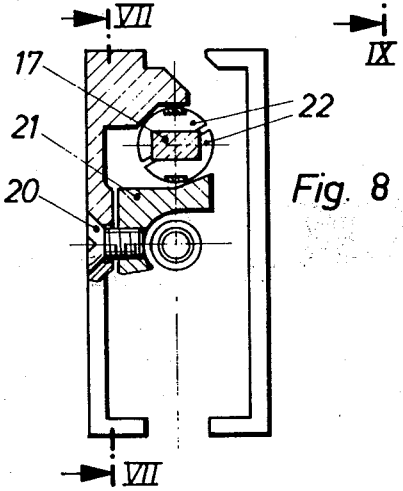
FIG. 8 is a section aong the line VIII—VIII of FIG. 7.
Figure 10:
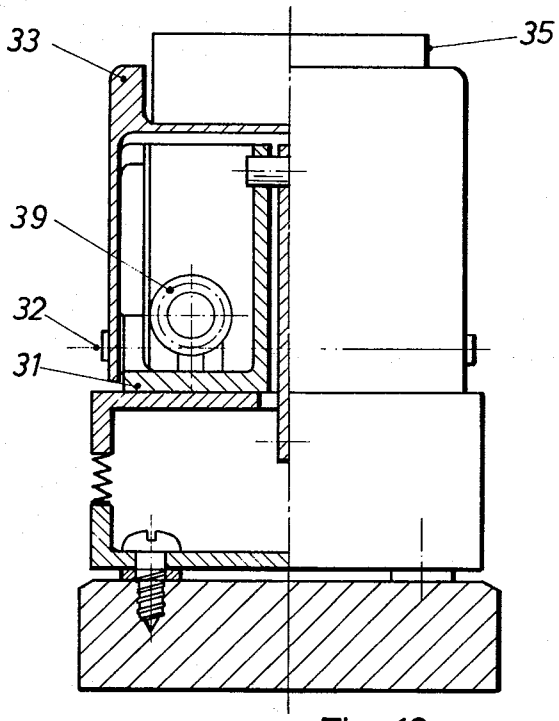
FIG. 10 is a section along the line X—X of FIG. 4.
Figure 11:
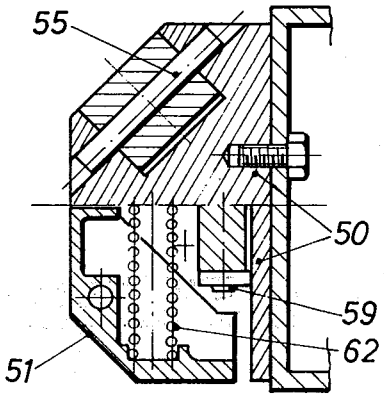
FIG. 11 is a section along the line XI—XI in FIG. 5.

According to FIG. 4 a sensing pin 25 is provided for forming the release signal, the said pin being attached to point P of plate 3 (FIG. 2) so as to be displaceable in the longitudinal direction ($x$). When upper plate 3 moves it slides on a conical surface 27 connected with the lower plate 1, so that the $y$ and $z$ displacements are combined and a path signal is produced in the $x$ direction (longitudinal direction of the ski). This signal acts on the securing system which has still to be described, which on reaching a predetermined signal magnitude suddenly and completely releases the boot quite independent of whether purely twisting or bending moments, or combined stresses exist. The release moments are adjustable by changing the length of the torsion rod 17 (FIG. 7). In addition, by constructing the torsion rods 17 in wedge-like manner it is possible to adjust the ratio of permitted twisting moment to bending moment with the length change.

The conical surface 27 is also displaceable in the longitudinal direction ($x$) so that therefore the binding can be opened manually.

In addition, it is possible by means of a helicoidal surface which is connected with the rotation of said upper plate 3 about the $x$ axis to displace the conical surface 27 in the $x$ direction and thereby superimpose the second bending moment $M_{Bx}$.

Pin 25 is arranged in the central vertical longitudinal plane of the binding and is guided in a longitudinally movable manner with the bearing blocks 26 which are rigidly connected with plate 3. Therefore the pin 25 follows the movements of the upper plate 3 in the case of rotary movements about the vertical axis 10 and the transverse axis 11. It slides on conical surface 27 mounted on base plate 1 and is therefore moved rearwards in the longitudinal direction of the ski. This movement is used as a control-signal in that it is transferred to a sole release mechanism provided in heel jaw 5 via the rod 16 coupled with pin 25 at 25'. The release of the sole takes place when the pin has reached a predetermined height on conical surface 27. The torsion rods and conical surface are designed in such a way that the bending and twisting moment portions are superimposed in accordance with the mathematical law mentioned hereinbefore. The binding is released, therefore, whenever the combined stressing of the leg has reached a critical value, no matter whether this is based on twisting, bending or combined twisting and bending.

The release can also take place manually in that the conical surface 27 is moved backwards by means of a bolt 28 firmly connected therewith and introduced at the front which is axially guided in bearings 29 firmly connected with plate 1 and is forwardly initially stressed by a spring 30, whereby that portion carrying conical surface 27 rests on the rearwardly positioned bearing of the two bearings 29.

The heel jaw 5 comprises a base plate 31, a casing 33 pivotable about axis 32 and to which is fixed in a height-adjustable manner a sole clamp 34 as well as a tension lever 35. A per se known toggle lever system comprising levers 36,37 and two tongues 38 is located within the casing. The system is arranged in the central vertical longitudinal plane and on it acts two laterally positioned axially extending springs 39, which increases the precision of the kinematics. By means of a cross bolt 40 lever 36 is fixed to the bottom of casing 33 whilst its upper end is connected with lever 37 by means of a cross bolt 41 which is in turn fixed by means of a cross bolt 42 into tongues 38. The lower ends of tongues 38 are pivotally mounted on casing 33 by means of cross bolt 43. Compression springs 39 supported on base plate 31 act on the toggle of the toggle lever system via bolt 41. As a result, in the indicated position a closing force is exerted via lever 36 on casing 33 i.e. a moment in counter-clockwise direction about axis 32 acts on casing 33.

The securing system release takes place in the following manner:

On pivoting plate 3 about vertical axis 10 and/or transverse axis 11, pin 25 is forced backwards by sliding up onto conical surface 27. This displacement of the pin which forms the control signal is transferred to a control lever 44 which pivots about transverse axis 45 and is mounted on base plate 31 by means of a rod 16. During its counter-clockwise rotation about axis 45, bolt 42 of lever 37 slides into the vertical portion of a control slot 56 constructed as shown in FIG. 4, which is so dimensioned and shaped that on reaching a predetermined displacement of rod 16, bolt 42 reaches an approximately 45% bend in the control slot 46 so that the toggle lever reaches its extended dead centre position and under the action of springs 39 snaps into its opening position. The lower portion of control slot 46 passes in approximately tangential direction in a circular path about transverse axis 45.

The force exerted on bolt 42 on extending the toggle lever produces an additional counter-clockwise moment in control lever 44, resulting in a rearwardly directed force in rod 16 which is used for unlocking the toe jaw. The function of the toe jaw will be described hereinafter.

Following the extension the togle lever passes into the second beyond dead centre position, not shown in FIG. 4, leading to a reversal of the force direction in lever 36 and consequently an opening of the jaw. In the open position a bolt 47 of upper lever 37 which rests from above on control lever 44 holds the latter in the terminal position reached in order to permit on the one hand the reliable opening of the toe jaw, and on the other to permit the re-closing of the heel jaw.

Closing initially takes place by swinging up tension lever 35 in the clockwise direction about axis 32. Springs 39 are so articulated by means of a bolt 48 to lever 35 that they are thereby relieved. As a result of the relieved springs the toggle lever system passes beyond the extended position into the initial position. The bolt 47 slides from control lever 44 so that its obstruction is removed and it can be pressed back into its initial position via spring 49 supported on base plate 31. Subsequently, tension lever 35 is closed again so that springs 39 are again placed under tension and casing 33 or clamp 34 can be pressed against boot 6. Any snow present between boot 6 and plate 3 has no influence on the automatic opening process. The clamping force of the jaw will merely be somewhat less as a result of the larger bend in the toggle lever system.

The toe jaw comprises a base plate 50 and two casing halves 51 and 52 whereon are fitted in height-displaceable manner clamps 53 and 54 and which can in each case be opened about an axis 55 inclined towards the inside by an angle of about 45° to the vertical. The two jaw halves are opened simultaneously via a positive guidance system comprising levers 56, 57 and 58. Lever 56 is pivotally mounted on the base plate via bolts 59 whilst levers 57 and 58 are in each case connected with lever 56 and casing halves 51 or 52 via ball cups 60. Clamps 53,54 have a surface 61 which is at a particular angle to the transverse direction which produce an opening moment in response to the longitudinal pressure exerted by the boot. Opening is aided by the incorporated transverse spring 62 which is in particular important when there is no axial pressure on the jaw. The jaw is kept closed by a stop lever 63 mounted on base plate 50 whereby the said lever 63 engages in bolt 64 of lever 56 and is pre-stressed by leaf spring 65. On releasing, the securing system rod 16 or pin 25, by means of lock nuts 66,67 adjustably mounted thereon, acts on the stop lever. The distance between lock nut 66 and stop lever 63 is appropriately larger than the maximum path of pin 25 so that the toe jaw can only be opened via rod 16 by means of the spring tension of the heel jaw. Consequently during the release of the heel jaw 5 no restoring force is transferred from the toe jaw to pin 25 which increases the release precision. Toe jaw 4 is opened after opening the tension lever 35 of heel jaw 5 which is effected by pressing down so that stop lever 63 automatically engages.

The embodiment of FIGS. 1–11 for producing a mechanical release signal is only one possible version, and on the basis thereof the release signal can also be produced electrically, magnetically, pneumatically or hydraulically.

The hitherto described part of the safety binding can be called the release system. It is an important feature of the invention that with every fall type (sideways, forwards, backwards or combined) only one release signal is produced which always reaches its critical value when the maximum permitted stressing of the shin bone is reached. This applies independently of external influences and particularly also when the skier falls when stationary or moving slowly. As is known, in such cases there is a particularly high risk of injury with the known bindings in such cases because the frictional forces (particularly in the case of twisting) influence the release in a not clearly defined manner.

The coupling of the bending and twisting moment portions according to the described mathematical law leads according to FIG. 3 to an ellipse. The shaded area represents the danger zone compared with the known uncoupled bindings such as, for example, described in DOS 1,920,484.

The system for securing boot 6 on upper plate 3 can be constructed in a different way to that described in FIGS. 4–10. The clamping of boot 6 can for example take place by means of jaws which are closed mechanically via springs or pneumatically/hydraulically. Furthermore, the connection between plate and boot can be obtained magnetically. However, all embodiments no matter whether they involve one or more parts must, according to the invention, have the following characteristics:

The securing forces must be less than the breaking values of the leg and can and must only be removed by one release signal whereby the complete securing system is unlocked.

FIGS. 12–18 show a further embodiment of the boot securing system, whereby the release system is constructed in the same way as in the previous embodiment. According to FIGS. 12 and 13 once again a ski plate 1 fixed to ski 2 and a boot plate 3 resiliently connected with the former are provided, and whereon is mounted the securing system having lateral jaws 104 and 105. The elongated flat jaws each have two attachments 106 whereon they are mounted in rotary manner about longitudinal axis 107; in addition the jaws have in each case two conical depressions 108 with a clearly defined angle of opening cooperating with the projections 109 of ski boot 6. The projections are located in a bore 111 of metal portion 112 embedded in sole 115. The external dimensions of this part as well as the bore spacings can be identical for all boot sizes and can therefore be standardized. As a result it is unnecessary to adjust the binding to particular boot sizes. For subsequent mounting to the ski boot upper portion 112 has two tongues 113,114 permitting screwing on from below. The metal portion is embedded in the boot in such a way that the shin bone axis passes through joint 9 of the binding.

In the present embodiment projections 109 are conical; however, they can also be spherical or non-symmetrical in their sectional plane. They have a cylindrical extension 117 which projects into bore 111. A spring 118 passes the projections outwardly against a stop member 119. According to the invention the spring tension is so large that it cannot be overcome by external forces so that the locating system comprising projection and jaw cannot be eliminated. However, the inclination 120 of jaws 105 or 104 is such that it is possible to step in.

The rods 121 which lead to the locking or unlocking mechanism are articulated to the attachment 106 of jaws 104 or 105. In the embodiment according to FIG. 14 the articulation point 122 is located below fulcrum point 107 whilst in the embodiment of FIG. 16 the articulation point 123 is located above fulcrum point 124 which leads to a somewhat different form of securing jaws 125 or 126.

According to FIGS. 17 and 18 the locking and unlocking mechanism is positioned below the boot plate 3. Rods 121 lead from jaws 104 and 105 to synchronization lever 127 which is mounted in rotary manner about a vertical axis 128. A lever arm of lever 127 is connected with toggle lever 129 whose end 130 is mounted on the casing. On toggle 131 is articulated a second toggle lever 132 which is also supported via its other end 133 on the casing. Toggle lever 132 has in its toggle a roller 134, e.g. a ball bearing, which can roll on surface 135 of control lever 144. The latter is connected via rod 16 and pin 25 which can slide in a longitudinal guide 26.

Figure 17:
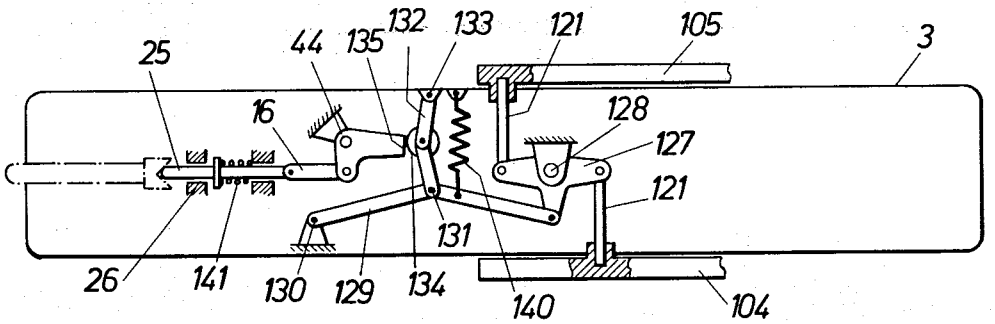
FIG. 17 is a schematic plan view of the locking/unlocking mechanism with a double toggle lever as mounted under the boot plate.

FIG. 17 shows the system in the locked state. Other control or disturbing forces are absorbed by the kinematics of the bearings and the control lever. The securing system is released in that pin 25 is moved rearwardly (controlled by the release system) and therefore rotates control lever 44 in counter-clockwise direction. As a result surface 135 rolls on roller 134. On reaching a predetermined path which is matched to the width of the surface the latter frees roller 134. As a result the lever mechanism is unlocked and the jaws open under the action of opening spring 140 or external forces. For normal opening pin 25 is moved rearwardly by hand. On closing the jaws spring 141 moves control lever 44 into its initial position again.

Figure 18:
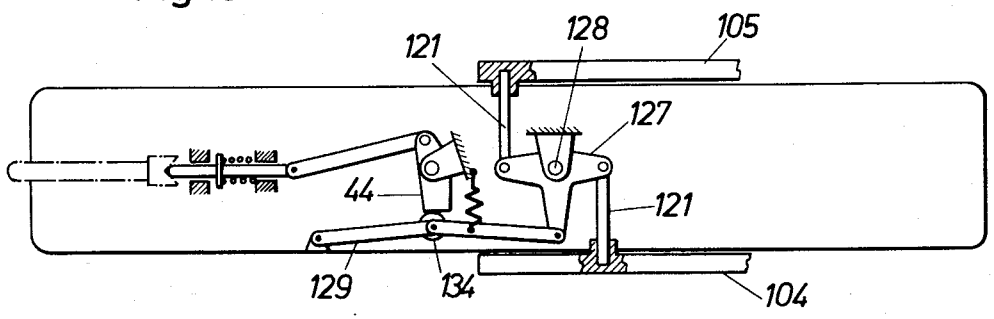
FIG. 18 is a schematic plan view identical to FIG. 17 of the locking/unlocking mechanism with a single toggle lever.

The alternative construction shown in FIG. 18 operates with a single toggle lever system whereby roller 134 is already located in the toggle of toggle lever 129. The control lever 44 therefore has a somewhat different configuration, but the remainder of the system and the operation remain unchanged.

While there has been described and illustrated the preferred embodiments of the invention, it is to be understood that these are capable of variation and modification, and it is not therefore desired to be limited to the precise details set forth but to include such modification and alterations as fall within the scope of the appended claims.

What is claimed is:

1. Safety ski binding apparatus comprising:

a first plate fixedly securable to a ski, a second plate spaced from said first plate, resilient connecting means connecting said first and second plates to one another while permitting movement of said second plate relative to said first plate about at least one vertical and at least one horizontal axis against the force of resilient members of said resilient connecting means, ski boot securing means for releasably securing a ski boot to said second plate, said securing means including means responsive to a release signal for effecting an automatic release of said ski boot from said second plate, and release signal generating means for generating a release signal to release said securing means in direct response to predetermined relative movement of said first and second plates with respect to one another.

2. Safety ski binding in accordance with claim 1, wherein the first and second plates are interconnected by said connecting means for pivotal movement about a horizontal axis extending transverse to the longitudinal direction of said ski, and wherein the rotation axes intersect at one point.

3. Safety ski binding in accordance with claim 2, wherein the vertical axis passes through the axis of the leg.

4. Safety ski binding in accordance with claim 2, wherein a resilient member is operative in at least two directions between the first plate and the second plate with a predetermined resistance which is adapted to the different torques about the individual axes.

5. Safety ski binding in accordance with claim 2, wherein said connecting means includes means for interconnecting said first and second plates for pivotal movement about a horizontal axis extending in the longitudinal direction of said ski, said longitudinal axis also intersecting in said point.

6. Safety ski binding according to claim 1., wherein said connecting means includes resilient member means operative in at least two directions between the boot plate and the ski plate which opposes rotary movements of the boot plate with a predetermined resistance which is adapted to the different torques about the individual axes.

7. Safety ski binding in accordance with claim 6, wherein the resilient member means comprises torsion rod means directed in the logitudinal direction of the ski.

8. Safety ski binding in accordance with claim 7, wherein the resilient member means (or the moments of inertia of the torsion rod means) is such that the ratio of horizontal to vertical spring rigidity corresponds to the ratio of permitted twisting moment to bending moment of the leg.

9. Safety ski binding in accordance with claim 8 wherein means are provided for varying the release moments or forces via the variation of the rigidity of the torsion rod means by length changes of the torsion rod means.

10. Safety ski binding in accordance with claim 9 wherein the cross-section of the torsion rod means varies via the length (e.g. wedge-shaped).

11. Safety ski binding in accordance with claim 1, wherein the space between the two plates is sealed by a sealing member between the first plate and the second plate.

12. Safety ski binding in accordance with claim 11 wherein said ski boot securing means comprises a heel jaw which has a spring operated toggle lever system for holding down purposes, and wherein said toggle system is constructed such that by releasing the mounting of a lever the toggle lever is extended leading to a reversal of the force direction for opening the jaw.

13. Safety ski binding in accordance with claim 12, wherein the release of the mounting in the horizontal direction takes place by a control lever connected to the pin, whereby the said control lever has a control slot which up to the maximum deflection of the release signal extends tangential to a circle having the pivot axis of said control lever at the center thereof and subsequently is inclined by about 45°to the tangent of the circle.

14. Safety ski binding in accordance with calim 13, wherein an upper lever of the toggle lever system has an extension with bolts which is configured such that after opening it holds the control lever in its opening position.

15. Safety ski binding in accordance with claim 14, with a manually operated tension lever for closing the jaw wherein the toggle lever springs are so connected to the tension lever that they bring about a closing moment and on opening the tension lever via the said springs the toggle lever can be returned to its initial position.

16. Safety ski binding in accordance with claim 15; wherein the control lever is connected with a restoring spring which on closing the jaw forces the jawback into its initial position.

17. Safety ski binding in accordance with claim 16, wherein a control mechanism is located in the centre of the jaw, and wherein a spring is disposed both to the left and to the right of said control mechanism for acting on the toggle lever system.

18. Safety ski binding in accordance with claim 1, wherein the vertical mounting of the first and second plates with respect to one another takes place by means of a ball-bearing.

19. Safety ski binding in accordance with claim 1, wherein the first plate is so connected with the ski by the connecting means that the ski can be freely deformed on loading.

20. Safety ski binding in accordance with claim 1, wherein a pin which slides on a conical surface (e.g. circular cone) and is movable in the longitudinal direction of the ski in response to relative movement of said first and second plates is used to produce the release signal.

21. Safety ski binding in accordance with claim 20, wherein for superimposing the bending moment about the horizontal longitudinal axis a helicoidal surface is used for transferring rotational movements of said first plate about said horizontal longitudinal axis as longitudinal movements to a member carrying the conical surface.

22. Safety ski binding in accordance with claim 20, wherein means are provided for facilitating longitudinal displacement of the conical surface.

23. Safety ski binding in accordance with claim 20, with a securing system comprising toe and heel jaws wherein on reaching a particular valueof value of release signal both jaws are suddently and simultaneously opened by said means responsive to a release signal.

24. Safety ski binding in accordance with claim 20, wherein means are provided for controlling the securing means via the pin.

25. Safety ski binding in accordance with claim 24, wherein the release of the mounting in the horizontal direction takes place by a control lever connected to the pin whereby the said control lever has a control slot which up to the maximum deflection of the release signal extends tangential to a circle having the pivot axis of the said control lever at the center thereof and subsequently is inclined by about 45° to the tangent of the circle.

26. Safety ski binding in accordance with claim 25 wherein the rotation point of the control lever has predetermined horizontal spacing relative to the control sot.

27. Safety ski binding in accordance with claim 1, wherein said securing means comprises toe and heel jaws, wherein on reaching a particular value of the release signal, both jaws are suddenly and simultaneously opened by said securing means.

28. Safety ski binding in accordance with claim 27, wherein the means responsive to the release signal initially opens the heel jaw and as a result of its opening force by means of a linkage, a stop lever of the toe jaw is unlocked.

29. Safety ski binding in accordance with claim 28, wherein said ski boot securing means comprises a heel jaw which has a spring operated toggle lever system for holding down purposes, and wherein said toggle system is constructed such that by releasing the mounting of a lever the toggle lever is extended leading to a reversal of the force direction for opening the jaw.

30. Safety ski binding in accordance with claim 27, wherein casing portions are provided which include two halves with clamps of the toe jaw, said casing portions being rotatable by about 45° round the inclined axes located in the transverse plane.

31. Safety ski binding in accordance with claim 30, wherein a lever system is provided for positively guiding the two housing halves so that whatever the loading which occurs the two clamps always open in the same way.

32. Safety ski binding in accordance with claim 31, wherein the lever system comprises three levers whereof one is mounted on a base plate of the toe jam so as to be rotatable solely about the horizontal transverse axis, and the two others are connected with the first lever and the casing halves being in each case pivotably movable about two axes.

33. Safety ski binding in accordance with claim 32, wherein the opening of the casing portions is blocked by a stop lever which engages on the free end of the first lever, and wherein a spring is provided for returning the stop lever to its initial position.

34. Safety ski binding in accordance with claim 31, wherein the clamps are provided with a vertical inclined plane whose angle to the transverse plane is sufficiently large that taking account of the friction between boot and clamp by compressive forces in the longitudinal direction of the ski an opening torque is always formed in the halves of the jaws.

35. Safety ski binding in accordance with claim 34, wherein a transverse spring is disposed between the casing halves.

36. Safety ski binding in accordance with claim 1, wherein said ski boot securing means comprises: jaws engaging laterally to the left and right in the sole of the boot, a common lever for synchronizing opening and closing of said jaws, and a pin forming part of said release signal generating means for locking and unlocking a toggle lever system using a control lever connected to the pin.

37. Safety ski binding in accordance with claim 36, wherein the sole of the boot has a rigid central portion (e.g. a metal plate) which for all boot sizes has the same standardizable dimensions and for subsequent attachment has in addition two tabs on the lower recessed surface of the sole.

38. Safety ski binding in accordance with claim 36, wherein one of the sole of the boot and the rigid central portion has both to the left and right at least one projection (e.g. frustums or spheres) with springs located behind said at least one projection whose dimensions and positions are also identical and standardizable for all boot sizes.

39. Safety ski binding in accordance with claim 38, wherein one of the projections and the central portion of the sole have a clearly defined position relative to the shin bone axis in the longitudinal direction of the boot.

40. Safety ski binding in accordance with claim 39, wherein means are provided for opening and closing the jaws about an axis located in the longitudinal direction of the ski.

41. Safety ski binding in accordance with claim 36, wherein the common lever is rotatable about a vertical axis and in each case via a rod is connected with the left or right-hand jaw.

42. Safety ski binding in accordance with claim 41, wherein the rods are articulated beneath the rotation axis of the jaws.

43. Safety ski binding in accordance with claim 41, wherein the rods are articulated above the rotation axis of the jaws.

44. Safety ski binding in accordance with claim 36, wherein the jaws on the inside have in each case at least one longitudinally displaced depression which cooperate with the projections on the boot.

45. Safety ski binding in accordance with claim 36, wherein the control lever has a curved surface which cooperates with a roller of the toggle lever whose radius corresponds to the length of the lever arm and whose width is a clearly defined quantity which determines the opening path.

46. Safety ski binding in accordance with claim 36, wherein the system has an opening spring having a limited spring tension (for overcoming frictional forces).

47. Safety ski binding in accordance with claim 36, wherein the control lever for the pin connected thereto has a restoring spring.

48. Safety ski binding in accordance with claim 1, wherein the plates are connected with one another by said connecting means such that the horizontal and vertical displacements of the boot plate produced by external forces are vectorially superimposed according to the following formula:

$$\left[\frac{M_T}{M_{Tmax.}}\right]^2 + \left[\frac{M_B}{M_{Bmax.}}\right]^2 = 1,$$

, wherein

| | | |
|---|---|---|
| $M_T$ | = | Twisting moment |
| $M_{Tmax.}$ | = | Maximum permitted twisting moment |
| $M_B$ | = | Bending moment |
| $M_{Bmax.}$ | = | Maximum permitted bending moment. |

49. Apparatus according to claim 1, wherein said connecting means includes means for permitting relative movement of said plates about three mutually perpendicular axes.

* * * * *